US006652610B2

(12) United States Patent
Krull et al.

(10) Patent No.: US 6,652,610 B2
(45) **Date of Patent: *Nov. 25, 2003**

(54) MULTIFUNCTIONAL ADDITIVE FOR FUEL OILS

(75) Inventors: Matthias Krull, Oberhausen (DE); Werner Reimann, Frankfurt (DE)

(73) Assignee: Clariant GmbH, Frankfurt (DE)

( * ) Notice: Subject to any disclaimer, the term of this patent is extended or adjusted under 35 U.S.C. 154(b) by 202 days.

This patent is subject to a terminal disclaimer.

(21) Appl. No.: 09/760,319

(22) Filed: Jan. 11, 2001

(65) Prior Publication Data

US 2002/0002793 A1 Jan. 10, 2002

(30) Foreign Application Priority Data

Jan. 11, 2000 (DE) ..... 100 00 650
Sep. 30, 2000 (DE) ..... 100 48 682

(51) Int. Cl.[7] ..... C10L 1/18; C10L 1/22; C10L 1/24

(52) U.S. Cl. ..... 44/383; 44/385; 44/388; 44/389; 44/394; 524/210; 524/285

(58) Field of Search ..... 44/383, 388, 385, 44/389, 394, 440; 524/210, 285

(56) References Cited

U.S. PATENT DOCUMENTS

| | | | | |
|---|---|---|---|---|
| 4,211,534 A | * | 7/1980 | Feldman | 44/394 |
| 4,491,455 A | | 1/1985 | Ishizaki et al. | |
| 4,713,088 A | | 12/1987 | Tack et al. | |
| 4,810,260 A | | 3/1989 | Tack et al. | |
| 4,863,486 A | | 9/1989 | Tack et al. | |
| 4,985,048 A | | 1/1991 | Wirtz et al. | |
| 5,186,720 A | | 2/1993 | Feustel et al. | |
| 5,254,652 A | * | 10/1993 | Reimann et al. | 526/331 |
| 5,391,632 A | | 2/1995 | Krull et al. | |
| 5,705,603 A | | 1/1998 | Krull et al. | |
| 5,767,190 A | | 6/1998 | Krull et al. | |
| 5,789,510 A | | 8/1998 | Krull et al. | |
| 5,891,203 A | | 4/1999 | Ball et al. | |
| 5,998,530 A | | 12/1999 | Krull et al. | |
| 6,010,545 A | * | 1/2000 | Davies et al. | 44/389 |
| 6,010,989 A | | 1/2000 | Krull et al. | |
| 6,086,645 A | * | 7/2000 | Quigley et al. | 600/570 |
| 6,251,146 B1 | * | 6/2001 | Jackson | 44/393 |
| 6,364,918 B1 | * | 4/2002 | Krull et al. | 44/386 |
| 6,391,071 B1 | * | 5/2002 | Krull et al. | 44/386 |
| 6,475,250 B2 | * | 11/2002 | Krull et al. | 44/383 |

FOREIGN PATENT DOCUMENTS

| | | |
|---|---|---|
| DE | 197 00 159 | 7/1998 |
| EP | 0 153 176 | 8/1985 |
| EP | 0 320 766 | 6/1989 |
| EP | 0 413 279 | 2/1991 |
| EP | 0 493 769 | 7/1992 |
| EP | 0 606 055 | 7/1994 |
| EP | 0 688 796 | 12/1995 |
| EP | 0 680 506 | 1/1997 |
| EP | 0 807 642 | 11/1997 |
| EP | 0 807643 | 11/1997 |
| EP | 0 807 676 | 11/1997 |
| EP | 0 857 776 | 8/1998 |
| EP | 0 892 012 | 1/1999 |
| EP | 0 900 836 | 3/1999 |
| EP | 0 926 168 | 6/1999 |
| EP | 0 960 908 | 12/1999 |
| WO | WO 95/33805 | 12/1995 |
| WO | WO 96/18706 | 6/1996 |
| WO | WO 96/18708 | 6/1996 |
| WO | WO 96/21709 | 6/1996 |
| WO | WO 97/45507 | 12/1997 |
| WO | WO 99/61562 | 12/1999 |

OTHER PUBLICATIONS

Ullmann's Encyclopedia of Industrial Chemistry, vol. A21, p. 305–413 Date unknown.
J. March, Advanced Organic Chemistry, 2. Auflage, S. 357 ff (1977).
N.A. Plate & V.P. Shibaev, J. Polymer Sci.: Macromolecular Reviews, vol. 8, Comb–like polymers, structure and properties, p. 117–253 (1974).
D. Wie, H. Spikes, Wear, vol. 111, Nr. 2 p. 217–235 (1986).
German office action regarding corresponding De 100 00 650.7, see AB & AC Above Date unknown.
European Search Report Date unknown.

* cited by examiner

*Primary Examiner*—Margaret Medley
(74) *Attorney, Agent, or Firm*—Richard P. Silverman

(57) ABSTRACT

The invention relates to additives for improving cold-flow and lubricating properties of fuel oils, comprising A) 5–95% by weight of at least one oil-soluble amphiphile of the formula

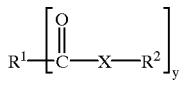

and/or

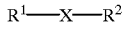

in which $R^1$ is an alkyl, alkenyl, hydroxyalkyl or aromatic radical having 1 to 50 carbon atoms, X is NH, $NR^3$, O or S, y is 1, 2, 3 or 4, $R^2$ is hydrogen or an alkyl radical carrying hydroxyl groups and having 2 to 10 carbon atoms and $R^3$ is an alkyl radical carrying nitrogen and/or hydroxyl groups and having 2 to 10 carbon atoms or $C_1$–$C_{20}$-alkyl, and B) 5 to 95% by weight of a terpolymer containing from 10 to 35 mol % of structural units derived from the vinyl ester of a carboxylic acid having 2 to 4 carbon atoms, from 1 to 15 mol % of structural units derived from the vinyl ester of a neocarboxylic acid having 8 to 15 carbon atoms, and structural units of ethylene to 100 mol %, having a melt viscosity, measured at 140° C., of from 20 to 10,000 mPas.

9 Claims, No Drawings

MULTIFUNCTIONAL ADDITIVE FOR FUEL OILS

BACKGROUND OF THE INVENTION

The present invention relates to an additive for fuel oils, containing ethylene/vinyl ester terpolymers and amphiphilic, lubrication-improving additives, and to its use for improving cold-flow and lubricating properties of the oils containing said additives.

Mineral oils and mineral oil distillates which are used as fuel oils generally contain 0.5% by weight or more of sulfur, which causes the formation of sulfur dioxide on combustion. To reduce the environmental pollutions resulting therefrom, the sulfur content of fuel oils is always further reduced. The introduction of the standard EN 590 relating to diesel fuels currently prescribes a maximum sulfur content of 500 ppm in Germany. In Scandinavia, fuel oils containing less than 50 ppm and, in exceptional cases, less than 10 ppm of sulfur are already in use. As a rule, these fuel oils are prepared by a procedure in which the fractions obtained from the mineral oil by distillation are refined with hydrogenation. During the desulfurization, however, other substances which impart a natural lubricating effect to the fuel oils are also removed. These substances include, inter alia, polyaromatic and polar compounds.

However, it has now been found that friction- and wear-reducing properties of fuel oils deteriorate with increasing degree of desulfurization. Often, these properties are so poor that signs of corrosion have to be expected after only a short time on the materials lubricated by the fuel, such as, for example, the distributor injection pumps of diesel engines. The further reduction of the 95% distillation point to below 370° C., in some cases to below 350° C. or below 330° C., which has now been implemented in Scandinavia makes these problems more critical.

The prior art therefore describes approaches which are intended to solve this problem (so-called lubricity additives).

EP-A-0 764 198 discloses additives which improve the lubricating effect of fuel oils and which contain polar nitrogen compounds based on alkylamines or alkylammonium salts having alkyl radicals of 8 to 40 carbon atoms.

EP-A-0 743 974 discloses the use of mixtures of lubricity additives (esters of polyhydric alcohols and carboxylic acids having 10 to 25 carbon atoms or dicarboxylic acids) and flow improvers comprising ethylene/unsaturated ester copolymers for the synergistic improvement of the lubricating effect of highly desulfurized oils.

EP-A-0 807 676 discloses the use of a mixture of a carboxamide and a cold-flow improver and/or an ashless dispersant for improving the cold flow properties of low-sulfur fuel oil.

EP-A-0 680 506 discloses the use of esters of monobasic or polybasic carboxylic acids with monohydric or polyhydric alcohols as lubricity additives for fuel oils.

The use of cold flow improvers in fuel oils is required since crude oils and middle distillates, such as gas oil, diesel oil or heating oil, obtained by distillation of crude oils contain amounts of long-chain paraffins (waxes) which differ depending on the origin of the crude oils. At low temperatures, these paraffins are precipitated as lamellar crystals, in some cases with inclusion of oil. This considerably impairs the flowability of the crude oils and the distillates obtained from them. Solid deposits occur and frequently lead to problems in production, transport and use of the mineral oils and mineral oil products. Thus, blockages of the filters occur at low ambient temperatures, for example in the cold season, inter alia in diesel engines and furnaces, and prevent safe metering of the fuel and finally result in an interruption of the supply of fuel or heating composition. Furthermore, the transport of the mineral oils and the mineral oil products through pipelines over relatively long distances may be adversely affected by the precipitation of paraffin crystals, for example in winter.

It is known that undesired crystal growth can be suppressed by suitable additives and any increase in the viscosity of the oils can thus be counteracted. Such additives, which are known by the term pour point depressants or flow improvers, change the size and shape of the wax crystals and thus counteract an increase in the viscosity of the oils.

EP-A-0 807 642 discloses cold flow improvers based on terpolymers which contain structural units of ethylene, vinyl acetate and 4-methyl-1-pentene, and EP-A-807 643 discloses those based on ethylene, vinyl acetate and norbornene.

It has been found that, in low-sulfur and paraffin-rich oils, the synergistic combination of additives of the prior art, in particular in cold blending which is becoming increasingly important in practice, i.e. mixing additives into cold oils, lead to filtration problems above the cloud point of the oils containing said additives. The result is often an impairment of the lubricating effect by the flow improver, and the oils do not have the properties expected of the components. For example, in the case of the additives according to EP-A-0 743 974, this is caused by the poor solubility of the flow improver component, with the result that blockage of fuel filters can occur. Presumably, the lubricants are absorbed by the more sparingly soluble components of the flow improver.

SUMMARY OF THE INVENTION

It was the object of the present invention to provide combinations of additives which lead to an improvement in the lubricating effect in middle distillates substantially freed of sulfur and aromatic compounds. At the same time, these additives should also contain a fraction as cold flow improvers which is soluble in said oils and is effective as such and which supports the action of the lubricity additive, and vice versa.

Surprisingly, it was found that additives which contain terpolymers of ethylene, vinyl esters and specific olefins in addition to lubrication-improving amphiphiles have the required properties.

DESCRIPTION OF THE PREFERRED EMBODIMENTS

The invention relates to additives for improving cold-flow and lubricating properties of fuel oils, comprising A) 5–95% by weight of at least one oil-soluble amphiphile of the formula (1)

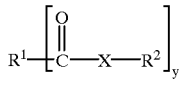

(1)

and/or (2)

in which $R^1$ is an alkyl, alkenyl, hydroxyalkyl or aromatic radical having 1 to 50 carbon atoms, X is NH, $NR^3$, O or S, y is 1, 2, 3 or 4, $R^2$ is hydrogen or an alkyl radical carrying hydroxyl groups and having 2 to 10 carbon atoms and $R^3$ is hydrogen, an alkyl radical carrying nitrogen and/or hydroxyl groups and having 2 to 10 carbon atoms or $C_1$–$C_{20}$-alkyl, and B) 5 to 95% by weight of a terpolymer containing from 3 to 18 mol % of structural units derived from the vinyl ester of a carboxylic acid having 2 to 4 carbon atoms, from 0.5 to 10 mol % of structural units derived from the vinyl ester of a neocarboxylic acid having 8 to 15 carbon atoms, and structural units of ethylene to 100 mol %, and having a melt viscosity, measured at 140° C., of from 20 to 10,000 mPas.

The invention furthermore relates to fuel oils which contain said additives.

The invention furthermore relates to the use of the additives for the simultaneous improvement of the lubricating and cold flow properties of fuel oils.

In a preferred embodiment of the invention the respective amounts of components A and B are 10 to 90, more preferred 20 to 80, especially 40 to 60% by weight.

The oil-soluble amphiphile (component A) preferably comprises a radical $R^1$ having 5 to 40, in particular 12 to 35, carbon atoms. Particularly preferably, $R^1$ is linear or branched and, in the case of linear radicals, contains 1 to 3 double bonds. The radical $R^2$ preferably has 2 to 8 carbon atoms and may be interrupted by nitrogen and/or oxygen atoms. In a further preferred embodiment, the sum of the carbon atoms of $R^1$ and $R^2$ is at least 10, in particular at least 15. In a further preferred embodiment, the component A carries 2 to 5 hydroxyl groups, each carbon atom carrying not more than one hydroxyl group.

In a preferred embodiment of the invention, X in the formula 1 is oxygen. These are in particular fatty acids and esters between carboxylic acids and dihydric or polyhydric alcohols. Preferred esters contain at least 10, in particular at least 12, carbon atoms. It is also preferable if the esters contain free hydroxyl groups, i.e. the esterification of the polyol with the carboxylic acid is not complete. Suitable polyols are, for example, ethylene glycol, propylene glycol, diethylene glycol and higher alkoxylation products, glycerol, trimethylolpropane, pentaerythritol, diglycerol and higher condensates of glycerol, and sugar derivatives. Further polyols containing hetero atoms, such as triethanolamine, are also suitable.

If X is a nitrogen-containing radical, reaction products of ethanolamine, diethanolamine, hydroxypropylamine, dihydroxypropylamine, n-methylethanolamine, diglycolamine and 2-amino-2-methylpropanol are suitable. The reaction is preferably carried out by amidation, the amides obtained, too, carrying free OH groups. Fatty acid monoethanolamides, diethanolamides and N-methylethanolamides may be mentioned as examples.

In a preferred embodiment or the invention, $R^3$ denotes a hydroxyl substituted alkyl group with 3 to 8 carbon atoms, or an alkyl group with 2 to 18, especially 4 to 12 carbon atoms.

In one embodiment, multifunctional additives may contain, as component A, compounds of the formula 3

(3)

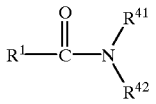

in which $R^1$ has the abovementioned meaning, $R^{41}$ is a radical of the formula 3a $$—(R^{43}—NR^{44})_m—R^{45} \quad (3a)$$

and $R^{42}$ is a radical of the formula 3b $$—(R^{43}—NR^{44})_n—R^{45} \quad (3b)$$

$R^{43}$ is a $C_2$- to $C_{10}$-alkylene group, $R^{44}$ is hydrogen, methyl, $C_2$- to $C_{20}$-alkyl, a radical of the formula 3c (3c)

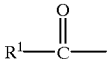

or an alkoxy radical, and $R^{45}$ is H or a radical of the formula 3c, and m and n, in each case independently of one another, are an integer from 0 to 20, preferably a) m and n not simultaneously being zero and b) the sum of m and n being at least 1 and not more than 20.

$R^{43}$ is preferably a $C_2$- to $C_8$-radical, in particular a $C_2$- to $C_4$-radical. The polyamine from which the structural unit formed from $R^{41}$, $R^{42}$ and the nitrogen atom linking them is derived is preferably ethylenediamine, diethylenetriamine, triethylenetetramine, tetraethylenepentamine or a higher homolog of aziridine, such as polyethyleneimine, and mixtures thereof. Parts of the amino group may be alkylated. Also suitable are star amines and dendrimers. These are understood as being polyamines having in general 2–10 nitrogen atoms which are linked to one another via $—CH_2—CH_2—$ groups and which are saturated with acyl or alkyl radicals in a position at the edge.

$R^{44}$ is preferably hydrogen, an acyl radical or an alkoxy group of the formula $—(OCH_2CH_2)_n—$, in which n is an integer from 1 to 10, and mixtures thereof.

Other suitable amphiphiles are compounds of the formula 3d (3d)

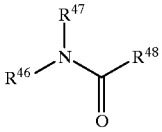

in which $R^{46}$ may have the meaning of $R^1$, $R^{47}$ may have the meaning of $R^1$ or H or may be $—[CH_2—CH_2—O—]_p—H$ and $R^{48}$ may have the meaning of $R^2$ and p is an integer from 1 to 10, with the proviso that at least one of the radicals $R^{46}$, $R^{47}$ and $R^{48}$ carries an OH group. γ-Hydroxybutyric acid tallow fatty amide may be mentioned as an example.

The amides are prepared in general by condensation of the polyamines with the carboxylic acids or derivatives thereof, such as esters of anhydrides. Preferably from 0.2 to 1.5 mol, in particular from 0.3 to 1.2 mol, especially 1 mol, of acid are used per base equivalent. The condensation is preferably carried out at temperatures of from 20 to 300° C., in particular from 50 to 200° C., the water of reaction being distilled off. For this purpose, solvents, preferably aromatic solvents, such as benzene, toluene, xylene, trimethylbenzene and/or commercial solvent mixtures, such as, for example, Solvent Naphtha, ®Shellsol AB, ®Solvesso 150 and ®Solvesso 200, may be added to the reaction mixture. The products according to the invention generally have a titratable base nitrogen content of 0.01–5% and an acid number of less than 20 mg KOH/g, preferably less than 10 mg KOH/g.

y preferably assumes the value 1 or 2. Examples of preferred groups of compounds with y=2 are derivatives of dimeric fatty acids and alkenylsuccinic anhydrides. The latter may carry linear as well as branched alkyl radicals, i.e. they may be derived from linear α-olefins and/or from oligomers of lower $C_3$–$C_5$-olefins, such as polypropylene or polyisobutylene.

Preferred polyols have 2 to 8 carbon atoms. They preferably carry 2, 3, 4 or 5 hydroxyl groups, but not more than the number of carbon atoms they contain. The carbon chain of the polyols may be straight, branched, saturated or unsaturated and may contain hetero atoms. It is preferably saturated.

Preferred carboxylic acids from which the compounds of the formula 1 may be derived or which constitute the compounds of the formula 1 have 5 to 40, in particular 12 to 30, carbon atoms. Preferably, the carboxylic acid has one or two carboxyl groups. The carbon chain of the carboxylic acids may be straight, branched, saturated or unsaturated. Preferably, more than 50% of the carboxylic acids used (mixtures) contain at least one double bond. Examples of preferred carboxylic acids include caprylic acid, capric acid, lauric acid, myristic acid, palmitic acid, stearic acid, oleic acid, elaidic acid, linoleic acid, linolenic acid and behenic acid, and carboxylic acids having hetero atoms, such as ricinoleic acid. Furthermore, dimeric and trimeric fatty acids, as obtainable, for example, by oligomerization of unsaturated fatty acids, and alkenylsuccinic acids may be used.

In a preferred embodiment, ethers and amines of the formula 2 are used as component A. These are partial ethers of polyols, such as, for example, glyceryl monooctadecyl ether, or amines carrying hydroxyl groups, as obtainable, for example, by alkoxylation of amines of the formula $R^1NH_2$ or $R^1R^3NH$ with alkylene oxides, preferably ethylene oxide and/or propylene oxide. 1–10, in particular 1–5, mol of alkylene oxide are preferably used per H atom of the nitrogen.

The vinyl esters of a carboxylic acid having 2 to 4 carbon atoms ("short-chain vinyl esters") which are contained in the terpolymer of component B) are preferably vinyl acetate or vinyl propionate.

The vinyl esters of neocarboxylic acids, which esters are furthermore contained in the terpolymer of component B), are derived from neocarboxylic acids of the formula

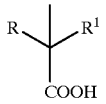

where each have from 8 to 15 carbon atoms altogether. R and $R^1$ are linear alkyl radicals. Preferably, the neocarboxylic acids are neononanoic, neodecanoic, neoundecanoic or neododecanoic acid.

The molar amounts of the short-chain vinyl esters in the terpolymer B) are preferably from 8 to 16 mol %. The molar amounts of the vinyl neocarboxylates are preferably from 1 to 8 mol %. The total comonomer content is from 8 to 19, in particular from 9 to 16, mol %.

Terpolymers according to the invention which have a melt viscosity, determined according to ISO 3219 (B) at 140° C., of from 50 to 5000 mPa.s, preferably from 30 to 1000 mPas and in particular from 50 to 500 mPa.s, are particularly suitable for use in the additive according to the invention.

For the preparation of the terpolymers of ethylene, the vinyl ester of an aliphatic linear or branched monocarboxylic acid which contains 2 to 40 carbon atoms in the molecule, and vinyl neocarboxylates, mixtures of the monomers are used as starting materials.

The copolymerization of the starting materials is carried out by known methods (in this context, cf. for example Ullmanns Encyclopadie der Technischen Chemie [Ullmann's Encyclopedia of Industrial Chemistry], 5th Edition, Vol. A21, pages 305 to 413). Polymerization in solution, in suspension and in the gas phase and high-pressure mass polymerization are suitable. High-pressure mass polymerization which is carried out at pressures of from 50 to 400 MPa, preferably from 100 to 300 MPa, and temperatures of from 50 to 350° C., preferably from 100 to 300° C., is preferably used. The reaction of the monomers is initiated by initiators forming free radicals (free radical chain initiators). This class of substance includes, for example, oxygen, hydroperoxides, peroxides and azo compounds, such as cumyl hydroperoxide, tert-butyl hydroperoxide, dilauroyl peroxide, dibenzoyl peroxide, bis (2-ethylhexyl) peroxodicarbonate, tert-butyl perpivalate, tert-butyl permaleate, tert-butyl perbenzoate, dicumyl peroxide, tert-butyl cumyl peroxide, di-tert-butyl peroxide, 2,2'-azobis(2-methylpropanonitrile) and 2,2'-azobis(2-methylbutyronitrile). The initiators are used individually or as a mixture of two or more substances, in amounts of from 0.01 to 20% by weight, preferably from 0.05 to 10% by weight, based on the monomer mixture.

For a given composition of the monomer mixture, the desired melt viscosity of the terpolymers is established by varying the reaction parameters of the pressure and temperature and, if required, by adding moderators. Hydrogen, saturated or unsaturated hydrocarbons, e.g. propane, aldehydes, e.g. propionaldehyde, n-butyraldehyde or isobutyraldehyde, ketones, e.g. acetone, methyl ethyl ketone, methyl isobutyl ketone or cyclohexanone, or alcohols, e.g. butanol, have proven useful moderators. Depending on the desired viscosity, the moderators are used in amounts of up to 20% by weight, preferably from 0.05 to 10% by weight, based on the monomer mixture.

To obtain terpolymers suitable for use in the additives according to the invention, monomer mixtures which, in addition to ethylene and, if required, a moderator, contain from 5 to 40% by weight, preferably from 10 to 40% by weight, of short-chain vinyl ester and from 1 to 40% by weight of vinyl neocarboxylate are used.

The differing polymerization rate of the monomers is taken into account by means of the composition of the monomer mixture, which composition differs from the composition of the terpolymer. The polymers are obtained as colorless melts, which solidify to waxy solids at room temperature.

For the preparation of additive packets for solving specific problems, the additives according to the invention can also be used together with one or more oil-soluble coadditives, which by themselves improve the cold flow properties and/or lubricating effect of crude oils, lubricating oils or fuel oils. Examples of such coadditives of paraffin dispersants are alkylphenol/aldehyde resins and comb polymers.

Paraffin dispersants reduce the size of the paraffin crystals and ensure that the paraffin particles do not settle out but remain dispersed in colloidal form with substantially reduced tendency to sedimentation. Oil-soluble polar compounds having ionic or polar groups, e.g. amine salts and/or amides, which are obtained by reacting aliphatic or aromatic amines, preferably long-chain aliphatic amines, with aliphatic or aromatic mono-, di-, tri- or tetracarboxylic acids or anhydrides thereof, have proven useful as paraffin dispersants. Other paraffin dispersants are copolymers of maleic anhydride and α,β-unsaturated compounds, which may, if required, be reacted with primary monoalkylamines and/or aliphatic alcohols, the reaction products of alkenylspirobislactones with amines and reaction products of terpolymers based on α,β-unsaturated dicarboxylic anhydrides, α,β-unsaturated compounds and polyoxyalkylene ethers of lower unsaturated alcohols. Alkylphenol formaldehyde resins, too, are suitable as paraffin dispersants. Some suitable paraffin dispersants are mentioned below.

Some of the paraffin dispersants mentioned below are prepared by reacting compounds which contain an acyl group with an amine. This amine is a compound of the formula $NR^6R^7R^8$, in which $R^6$, $R^7$ and $R^8$ may be identical or different, and at least one of these groups is $C_8$–$C_{36}$-alkyl, $C_6$–$C_{36}$-cycloalkyl, $C_8$–$C_{36}$-alkenyl, in particular $C_{12}$–$C_{24}$-alkyl, $C_{12}$–$C_{24}$-alkenyl or cyclohexyl, and the remaining groups are either hydrogen, $C_1$–$C_{36}$-alkyl, $C_2$–$C_{36}$-alkenyl, cyclohexyl or a group of the formula $—(A—O)_x—E$ or $—(CH_2)_n—NYZ$, in which A is an ethylene or propylene group, x is a number from 1 to 50, E is H, $C_1$–$C_{30}$-alkyl, $C_5$–$C_{12}$-cycloalkyl or $C_6$–$C_{30}$-aryl and n is 2 3 or 4, and Y and Z, independently of one another, are H, $C_1$–$C_{30}$-alkyl or $—(A—O)_x$. Here, acyl group is understood as meaning a functional group of the following formula:

(>C═O)

1. Reaction products of alkenylspirobislactones of the formula 4

(4)

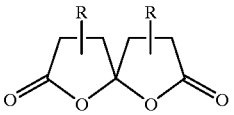

in which R in each case is $C_8$–$C_{200}$-alkenyl, with amines of the formula $NR^6R^7R^8$. Suitable reaction products are mentioned in EP-A-0 413 279. Depending on the reaction conditions, amides or amide-ammonium salts are obtained in the reaction of compounds of the formula (4) with the amines.

2. Amides or ammonium salts of aminoalkylenepolycarboxylic acids with secondary amines of the formulae 5 and 6

(5)

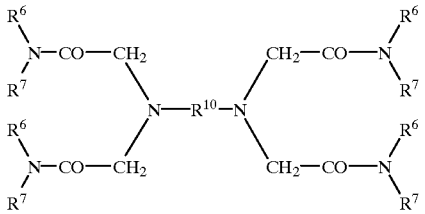

(6)

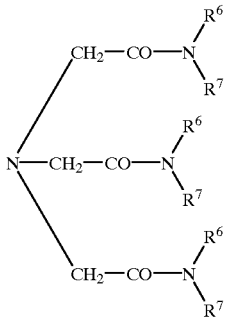

in which $R^{10}$ is a straight-chain or branched alkylene radical having 2 to 6 carbon atoms or the radical of the formula 7

(7)

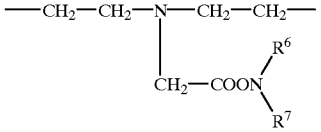

in which $R^6$ and $R^7$ are in particular alkyl radicals having 10 to 30, preferably 14 to 24 carbon atoms, it also being possible for some or all of the amide structures to be present in the form of the ammonium salt structure of the formula 8

(8)

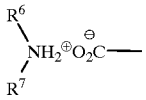

The amides or amide-ammonium salts or ammonium salts, for example of nitrilotriacetic acid, of ethylenediaminetetraacetic acid or of propylene-1,2-diaminetetraacetic acid, are obtained by reacting the acids with from 0.5 to 1.5 mol of amine, preferably from 0.8 to 1.2 mol of amine, per carboxyl group. The reaction temperatures are from about 80 to 200° C., continuous removal of the resulting water of reaction being carried out for the preparation of the amides. However, the reaction need not be continued to the amide and instead from 0 to 100 mol % of the amine used may be present in the form of the ammonium salt. Under analogous conditions, the compounds mentioned under B1) can also be prepared.

Particularly suitable amines of the formula 9

(9)

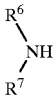

are dialkylamines in which $R^6$ and $R^7$ are each a straight-chain alkyl radical having 10 to 30 carbon atoms, preferably 14 to 24 carbon atoms. Dioleylamine, dipalmitylamine, dicoconut fatty amine and dibehenylamine and preferably di-tallow fatty amine may be mentioned specifically.

3. Quaternary ammonium salts of the formula 10

$$^{\oplus}NR^6R^7R^8R^{11}X \quad (10)$$

in which $R^6$, $R^7$ and $R^8$ have the abovementioned meanings and $R^{11}$ is $C_1$–$C_{30}$-alkyl, preferably $C_1$–$C_{22}$-alkyl, $C_1$–$C_{30}$-alkenyl, preferably $C_1$–$C_{22}$-alkenyl, benzyl or a radical of the formula $—(CH_2—CH_2—O)_n—R^{12}$, in which $R^{12}$ is hydrogen or a fatty acid radical of the formula $C(O)—R^{13}$, where $R^{13}$═$C_6$–$C_{40}$-alkenyl, n is a number from 1 to 30 and X is halogen, preferably chlorine, or a methosulfate.

The following may be mentioned as examples of such quaternary ammonium salts: dihexadecyldimethylammonium chloride, distearyldimethylammonium chloride, quaternization products of esters of di- and triethanolamines with long-chain fatty acids (lauric acid, myristic acid, palmitic acid, stearic acid, behenic acid, oleic acid and fatty acid mixtures, such as coconut fatty acid, tallow fatty acid, hydrogenated tallow fatty acid and tall oil fatty acid) such as N-methyltriethanolammonium distearyl ester chloride, N-methyltriethanolammonium distearyl ester methosulfate, N,N-dimethyldiethanolammonium distearyl ester chloride, N-methyltriethanolammonium dioleyl ester chloride, N-methyltriethanolammonium trilauryl ester methosulfate, N-methyltriethanolammonium tristearyl ester methosulfate and mixtures thereof.

4. Compounds of the formula 11

(11)

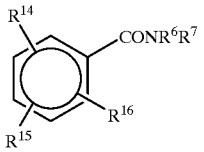

in which $R^{14}$ is $CONR^6R^7$ or $CO_2^{-+}H_2NR^6R^7$, $R^{15}$ and $R^{16}$ are H, $CONR^{17}_2$, $CO_2^{17}$ or $OCOR^{17}$, —$OR^{17}$, —$R^{17}$ or —$NCOR^{17}$, and $R^{17}$ is alkyl, alkoxyalkyl or polyalkoxyalkyl and has at least 10 carbon atoms.

Preferred carboxylic acids or acid derivatives are phthalic acid (anhydride), trimellitic acid (anhydride), pyromellitic acid (dianhydride), isophthalic acid, terephthalic acid, cyclohexanedicarboxylic acid (anhydride), maleic acid (anhydride) and alkenylsuccinic acid (anhydride). The formulation (anhydride) means that the anhydrides of said acids are also preferred acid derivatives.

If the compounds of the formula (11) are amides or amine salts, they are preferably derived from a secondary amine which contains a group containing hydrogen and carbon and having at least 10 carbon atoms.

It is preferable if $R^{17}$ contains 10 to 30, in particular 10 to 22, e.g. 14 to 20, carbon atoms and is preferably straight-chain or is branched at the 1- or 2-position. The other groups containing hydrogen and carbon may be shorter, for example may contain less than 6 carbon atoms, or, if desired, may have at least 10 carbon atoms. Suitable alkyl groups include methyl, ethyl, propyl, hexyl, decyl, dodecyl, tetradecyl, eicosyl and docosyl (behenyl).

Further suitable polymers are those which contain at least one amido or ammonium group bonded directly to the polymer skeleton, the amido or ammonium group carrying at least one alkyl group of at least 8 carbon atoms on the nitrogen atom. Such polymers can be prepared in various ways. One method is to use a polymer which contains a plurality of carboxylic acid or carboxyl anhydride groups and to react this polymer with an amine of the formula $NHR^6R^7$ to obtain the desired polymer.

Suitable polymers for this purpose are in general copolymers of unsaturated esters, such as $C_1$–$C_{40}$-alkyl (meth) acrylates and dialkyl fumarates, $C_1$–$C_{40}$-alkyl vinyl ethers, $C_1$–$C_{40}$-alkylvinyl esters or $C_2$–$C_{40}$-olefins (linear, branched, aromatic) with unsaturated carboxylic acids or their reactive derivatives, such as, for example, carboxylic anhydrides (acrylic acid, methacrylic acid, maleic acid, fumaric acid, tetrahydrophthalic acid or citranonic acid, preferably maleic anhydride).

Carboxylic acids are preferably reacted with from 0.1 to 1.5 mol, in particular from 0.5 to 1.2 mol, of amine per acid group, and carboxylic anhydride preferably with from 0.1 to 2.5, in particular from 0.5 to 2.2, mol of amine per acid anhydride group, amides, ammonium salts, amidoammonium salts or imides being formed, depending on the reaction conditions. Thus, in the reaction with secondary amine, copolymers which contain unsaturated carboxylic anhydrides give a product in which half the amount is amide and half amine salts, owing to the reaction with the anhydride group. By heating, water can be eliminated with formation of the diamide.

Particularly suitable examples of polymers containing amide groups and intended for use according to the invention are:

5. Copolymers (a) of a dialkyl fumarate, maleate, citraconate or itaconate with maleic anhydride, or (b) of vinyl esters, e.g. vinyl acetate or vinyl stearate, with maleic anhydride, or (c) of a dialkyl fumarate, maleate, citraconate or itaconate with maleic anhydride and vinyl acetate.

Particularly suitable examples of these polymers are copolymers of didodecyl fumarate, vinyl acetate and maleic anhydride; ditetradecyl fumarate, vinyl acetate and maleic anhydride; dihexadecyl fumarate, vinyl acetate and maleic anhydride; or the corresponding copolymers in which the itaconate is used instead of the fumarate.

In the abovementioned examples of suitable polymers, the desired amide is obtained by reacting the polymer which contains anhydride groups with a secondary amine of the formula $HNR^6R^7$ (if necessary, also with an alcohol if an ester amide is formed). If polymers which contain an anhydride group are reacted, the resulting amino groups will be ammonium salts and amides. Such polymers can be used with the proviso that they contain at least two amido groups.

It is important that the polymer which contains at least two amido groups contains at least one alkyl group having at least 10 carbon atoms. This long-chain group, which may be a straight-chain or branched alkyl group, can be linked to the amido group via the nitrogen atom.

The amines suitable for this purpose may be represented by the formula $R^6R^7NH$ and the polyamines by $R^6NH[R^{19}NH]_xR^7$, in which $R^{19}$ is a divalent hydrocarbon group, preferably an alkylene or hydrocarbon-substituted alkylene group, and x is an integer, preferably from 1 to 30. Preferably, one of the two or both radicals $R^6$ and $R^7$ contains or contain at least 10 carbon atoms, for example 10 to 20 carbon atoms, for example dodecyl, tetradecyl, hexadecyl or octadecyl.

Examples of suitable secondary amines are dioctylamine and those which contain alkyl groups having at least 10 carbon atoms, for example didecylamine, didodecylamine, dicocosamine (i.e. mixed $C_{12}$–$C_{14}$-amines), dioctadecylamine, hexadecyloctadecylamine, di(hydrogenated tallow)-amine (approximately 4% by weight of n-$C_{14}$-alkyl, 30% by weight of n-$C_{10}$-alkyl and 60% by weight of n-$C_{18}$-alkyl, the remainder being unsaturated).

Examples of suitable polyamines are N-octadecylpropanediamine, N,N'-dioctadecylpropanediamine, N-tetradecylbutanediamine and N,N'-dihexadecylhexanediamine, N-cocospropylenediamine ($C_{12}$/$C_{14}$-alkylpropylenediamine), N-tallow-propylenediamine ($C_{16}$/$C_{18}$-alkylpropylenediamine).

The amide-containing polymers usually have an average molecular weight (number average) of from 1000 to 500,000, for example from 10,000 to 100,000.

6. Copolymers of styrene, of its derivatives or of aliphatic olefins having 2 to 40 carbon atoms, preferably having 6 to 20 carbon atoms, and olefinically unsaturated carboxylic acids and carboxylic anhydrides which are reacted with amines of the formula $HNR^6R^7$. The reaction can be carried out before or after the polymerization.

Specifically, the structural units of the copolymers are derived from, for example, maleic acid, fumaric acid, tetrahydrophthalic acid, citraconic acid or preferably maleic anhydride. They may be used both in the form of their homopolymers and in the form of the copolymers. Suitable copolymers are: styrene, alkylstyrenes, straight-chain or branched olefins having 2 to 40 carbon atoms and their mixtures with one another. The following may be mentioned by way of example: styrene, α-methylstyrene, dimethylstyrene, α-ethylstyrene, diethylstyrene, isopropylstyrene, tert-butylstyrene, ethylene, propylene, n-butylene, diisobutylene, decene, dodecene, tetradecene, hexadecene and octadecene. Styrene and isobutene are preferred and styrene is particularly preferred.

The following may be mentioned as specific examples of polymers: polymaleic acid, a molar styrene/maleic acid copolymer having an alternating structure, random styrene/maleic acid copolymers in the ratio 10:90 and an alternating copolymer of maleic acid and isobutene. The molar masses of the polymers are in general from 500 g/mol to 20,000 g/mol, preferably from 700 to 2000 g/mol.

The reaction of the polymers or copolymers with the amines is carried out at temperatures of from 50 to 200° C. in the course of from 0.3 to 30 hours. The amine is used in amounts of about one mole per mol of dicarboxylic anhydride incorporated as polymerized units, i.e. from about 0.9 to 1.1 mol/mol. The use of larger or smaller amounts is possible but is of no advantage. If amounts larger than one mole are used, ammonium salts are obtained in some cases since the formation of a second amido group requires higher temperatures, longer residence times and removal of water. If amounts smaller than one mole are used, complete reaction to the monoamide does not take place and a correspondingly reduced effect is obtained.

Instead of the subsequent reaction of carboxyl groups in the form of the dicarboxylic anhydride with amines to give the corresponding amides, it may sometimes be advantageous to prepare the monoamides of the monomers and then to incorporate them as polymerized units directly in the polymerization. In general, however, this is technically much more complicated since the amines can undergo addition at the double bond of the monomeric mono- or dicarboxylic acid, and copolymerization is then no longer possible.

7. Copolymers comprising from 10 to 95 mol % of one or more alkyl acrylates or alkyl methacrylates having $C_1$–$C_{26}$-alkyl chains and comprising from 5 to 90 mol % of one or more ethylenically unsaturated dicarboxylic acids or anhydrides thereof, the copolymer being reacted substantially with one or more primary or secondary amines to give the monoamide or amide/ammonium salt of the dicarboxylic acid.

The copolymers comprise from 10 to 95 mol %, preferably from 40 to 95 mol % and particularly preferably from 60 to 90 mol %, of alkyl (meth)acrylates and from 5 to 90 mol %, preferably from 5 to 60 mol % and particularly preferably from 10 to 40 mol % of the olefinically unsaturated dicarboxylic acid derivatives. The alkyl groups of the alkyl (meth)acrylates contain from 1 to 26, preferably from 4 to 22 and particularly preferably from 8 to 18 carbon atoms. They are preferably straight-chain and not branched. However, up to 20% by weight of cyclic and/or branched fractions may also be present.

Examples of particularly preferred alkyl (meth)acrylates are n-octyl (meth)acrylate, n-decyl (meth)acrylate, n-dodecyl (meth)acrylate, n-tetradecyl (meth)acrylate, n-hexadecyl (meth)acrylate and n-octadecyl (meth)acrylate and mixtures thereof.

Examples of ethylenically unsaturated dicarboxylic acids are maleic acid, tetrahydrophthalic acid, citraconic acid and itaconic acid and anhydrides thereof and fumaric acid. Maleic anhydride is preferred.

Suitable amines are compounds of the formula $HNR^6R^7$.

As a rule, it is advantageous to use the dicarboxylic acids in the copolymerization in the form of the anhydrides, where available, for example maleic anhydride, itaconic anhydride, citraconic anhydride and tetrahydrophthalic anhydride, since the anhydrides generally copolymerize better with the (meth)acrylates. The anhydride groups of the copolymers can then be reacted directly with the amines.

The reaction of the polymers with the amines is carried out at temperatures of from 50 to 200° C. in the course of from 0.3 to 30 hours. The amine is used in amounts of from about one to two moles per mol of dicarboxylic anhydride incorporated as polymerized units, i.e. from about 0.9 to 2.1 mol/mol. The use of larger or smaller amounts is possible but is of no advantage. If amounts larger than two moles are used, then free amine is present. If amounts smaller than one mole are used, complete reaction to the monoamide does not take place, and a correspondingly reduced effect is obtained.

In some cases, it may be advantageous if the amide/ammonium salt structure is composed of two different amines. Thus, for example, a copolymer of lauryl acrylate and maleic anhydride can first be reacted with a secondary amine, such as hydrogenated di-tallow-fatty amine to give the amide, after which the free carboxyl group originating from the anhydride is neutralized with another amine, e.g. 2-ethylhexylamine, to give the ammonium salt. The opposite procedure is just as possible: the reaction is carried out first with ethylhexylamine to give the monoamide and then the di-tallow-fatty amine to give the ammonium salt. It is preferable to use at least one amine which has at least one straight-chain, nonbranched alkyl group having more than 16 carbon atoms. It is not important whether this amine participates in the synthesis of the amide structure or is present as the ammonium salt of the dicarboxylic acid.

Instead of the subsequent reaction of the carboxyl groups or of the dicarboxylic anhydride with amines to give the corresponding amides or amide/ammonium salts, it may sometimes be advantageous to prepare the monoamides or amide/ammonium salts of the monomers and then to incorporate them as polymerized units directly in the polymerization. In general, however, this is technically much more complicated since the amines can undergo addition at the double bond of the monomeric dicarboxylic acid, and copolymerization is then no longer possible.

8. Terpolymers based on α,β-unsaturated dicarboxylic anhydrides, α,β-unsaturated compounds and polyoxyalkylene ethers of lower, unsaturated alcohols which contain 20–80, preferably 40–60, mol % of bivalent structural units of the formulae 12 and/or 14 and, if required, 13, the structural units 13 originating from unreacted anhydride radicals, (12)

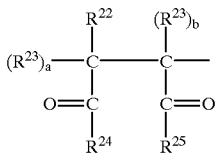

(13)

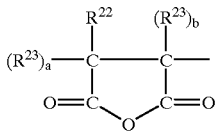

-continued (14)

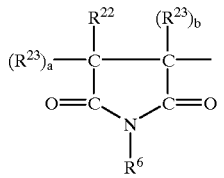

in which $R^{22}$ and $R^{23}$, independently of one another, are hydrogen or methyl, a and b are zero or one and a+b is one, and $R^{24}$ and $R^{25}$ are identical or different and are the groups —$NHR^6$, $N(R^6)_2$ and/or —$OR^{27}$, and $R^{27}$ is a cation of the formula $H_2N(R^6)_2$ or $H_3NR^6$, 19–80 mol %, preferably 39–60 mol %, of bivalent structural units of the formula 15

(15)

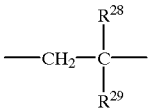

in which $R^{28}$ is hydrogen or $C_1$–$C_4$-alkyl and $R^{29}$ is $C_6$–$C_{60}$-alkyl or $C_6$–$C_{18}$-aryl, and 1–30 mol %, preferably 1–20 ml %, of bivalent structural units of the formula 16

(16)

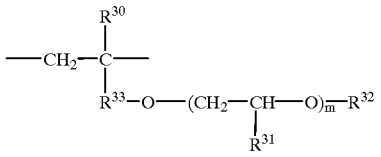

in which $R^{30}$ is hydrogen or methyl, $R^{31}$ is hydrogen or $C_1$–$C_4$-alkyl, $R^{33}$ is $C_1$–$C_4$-alkylene, m is a number from 1 to 100, $R^{32}$ is $C_1$–$C_{24}$-alkyl, $C_5$–$C_{20}$-cycloalkyl, $C_6$–$C_{18}$-aryl or —C(O)—$R^{34}$, in which $R^{34}$ is $C_1$–$C_{40}$-alkyl, $C_5$–$C_{10}$-cycloalkyl or $C_6$–$C_{18}$-aryl.

The abovementioned alkyl, cycloalkyl and aryl radicals may be optionally substituted. Suitable substituents of the alkyl and aryl radicals are, for example, ($C_1$–$C_6$)-alkyl, halogens, such as fluorine, chlorine, bromine and iodine, preferably chlorine, and ($C_1$–$C_6$)-alkoxy.

Here, alkyl is a straight-chain or branched hydrocarbon radical. The following may be mentioned specifically: n-butyl, tert-butyl, n-hexyl, n-octyl, decyl, dodecyl, tetradecyl, hexadecyl, octadecyl, dodecenyl, tetrapropenyl, tetradecenyl, pentapropenyl, hexadecenyl, octadecenyl and eicosanyl or mixtures, such as cocosalkyl, tallow-fatty alkyl and behenyl.

Here, cycloalkyl is a cyclic aliphatic radical having 5–20 carbon atoms. Preferred cycloalkyl radicals are cyclopentyl and cyclohexyl.

Here, aryl is an optionally substituted aromatic ring system having 6 to 18 carbon atoms.

The terpolymers comprise the bivalent structural units of the formulae 12 and 14 as well as 15 and 16 and optionally 13. In addition, they contain, in a manner known per se, only the terminal groups formed in the polymerization by initiation, inhibition and chain termination.

Specifically, structural units of the formulae 12 to 14 are derived from α,β-unsaturated dicarboxylic anhydrides of the formulae 17 and 18

(17)

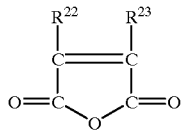

(18)

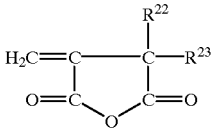

such as maleic anhydride, itaconic anhydride or citraconic anhydride, preferably maleic anhydride.

The structural units of the formula 15 are derived from the α,β-unsaturated compounds of the formula 19.

(19)

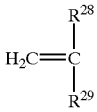

The following α,β-unsaturated olefins may be mentioned by way of example: styrene, α-methylstyrene, dimethylstyrene, α-ethylstyrene, diethylstyrene, isopropylstyrene, tert-butylstyrene, diisobutylene and α-olefins, such as decene, dodecene, tetradecene, pentadecene, hexadecene, octadecene, $C_{20}$-α-olefin, $C_{24}$-α-olefin, $C_{30}$-α-olefin, tripropenyl, tetrapropenyl, pentapropenyl and mixtures thereof. α-Olefins having 10 to 24 carbon atoms and styrene are preferred, and α-olefins having 12 to 20 carbon atoms are particularly preferred.

The structural units of the formula 16 are derived from polyoxyalkylene ethers of lower, unsaturated alcohols of the formula 20.

(20)

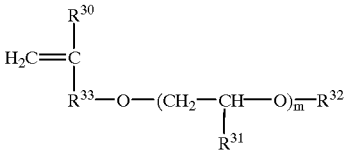

The monomers of the formula 20 are etherification products ($R^{32}$=—C(O)$R^{34}$) or esterification products ($R^{32}$=—C(O)$R^{34}$) of polyoxyalkylene ethers ($R^{32}$=H).

The polyoxyalkylene ethers ($R^{32}$=H) can be prepared by known processes, by an addition reaction of α-olefin oxides, such as ethylene oxide, propylene oxide and/or butylene oxide, with polymerizable lower, unsaturated alcohols of the formula 21

(21)

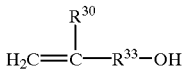

Such polymerizable lower, unsaturated alcohols are, for example, allyl alcohol, methallyl alcohol, butenols, such as 3-buten-1-ol, 1-buten-3-ol or methylbutenols, such as 2-methyl-3-buten-1-ol, 2-methyl-3-buten-2-ol and 3-methyl-3-buten-1-ol. Adducts of ethylene oxide and/or propylene oxide with allyl alcohol are preferred.

A subsequent etherification of these polyoxyalkylene ethers to give compounds of the formula 20 where $R^{32}$=$C_1$–$C_{24}$-alkyl, cycloalkyl or aryl is carried out by processes known per se. Suitable processes are disclosed, for example, in J. March, Advanced Organic Chemistry, 2nd edition, page 357 et seq. (1977). These etherification products of the polyoxyalkylene ethers can also be prepared by subjecting α-olefin oxides, preferably ethylene oxide, propylene oxide and/or butylene oxide, to an addition reaction with alcohols of the formula 22

$$R^{32}—OH \quad (22)$$

in which $R^{32}$ is $C_1$–$C_{24}$-alkyl, $C_5$–$C_{20}$-cycloalkyl or $C_6$–$C_{18}$-aryl, by known processes and to a reaction with polymerizable lower, unsaturated halides of the formula 23

(23)

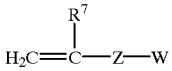

in which W is a halogen atom. The halides used are preferably the chlorides and bromides. Suitable preparation processes are mentioned, for example, in J. March, Advanced Organic Chemistry, 2nd edition, page 357 et seq. (1977). The esterification of the polyoxyalkylene ethers ($R^{32}$=—C(O)—$R^{34}$) is carried out by a reaction with conventional esterification agents, such as carboxylic acids, carbonyl halides, carboxylic anhydrides or carboxylic esters with $C_1$–$C_4$-alcohols. The halides and anhydrides of $C_1$–$C_{40}$-alkanecarboxylic, $C_5$–$C_{10}$-cycloalkanecarboxylic or $C_6$–$C_{18}$-arylcarboxylic acids are preferably used. The esterification is carried out in general at temperatures of from 0 to 200° C., preferably from 10 to 100° C.

In the case of the monomers of the formula 20, the index m indicates the degree of alkoxylation, i.e. the number of moles of α-olefins which undergo addition per mole of the formula 20 or 21.

The following may be mentioned as examples of primary amines suitable for the preparation of the terpolymers:

n-hexylamine, n-octylamine, n-tetradecylamine, n-hexadecylamine, n-stearylamine and N,N-dimethylaminopropylenediamine, cyclohexylamine, dehydroabietylamine and mixtures thereof.

The following may be mentioned as examples of secondary amines suitable for the preparation of the terpolymers: didecylamine, ditetradecylamine, distearylamine, dicocosfatty amine, di-tallow-fatty amine and mixtures thereof.

The terpolymers have K values (measured according to Ubbelohde in 5% strength by weight solution in toluene at 25° C.) of from 8 to 100, preferably from 8 to 50, corresponding to average molecular weights ($M_w$) of from about 500 to 100,000. Suitable examples are mentioned in EP 606 055.

9. Reaction products of alkanolamines and/or polyetheramines with polymers containing dicarboxylic anhydride groups, wherein said reaction products contain 20–80, preferably 40–60, mol % of bivalent structural units of the formulae 25 and 27 and optionally 26

(25)

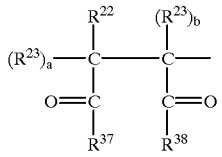

(26)

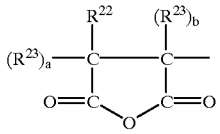

(27)

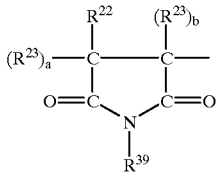

in which $R^{22}$ and $R^{23}$, independently of one another, are hydrogen or methyl, a and b are zero or 1 and a+b is 1, $R^{37}$ is —OH, —O—[$C_1$–$C_{30}$-alkyl], —$NR^6R^7$, —$O^sN'R^6R^7H_2$, $R^{38}$ is $R^{37}$ or $NR^6R^{39}$ and $R^{39}$ is —$(A—O)_x$—E where A is ethylene or propylene, x is from 1 to 50 and E is H, $C_1$–$C_{30}$-alkyl, $C_5$–$C_{12}$-cycloalkyl or $C_6$–$C_{30}$-aryl, and 80–20 mol %, preferably 60–40 mol %, of bivalent structural units of the formula 15.

Specifically, the structural units of the formulae 25, 26 and 27 are derived from α,β-unsaturated dicarboxylic anhydrides of the formulae 17 and/or 18.

The structural units of the formula 15 are derived from the α,β-unsaturated olefins of the formula 19. The abovementioned alkyl, cycloalkyl and aryl radicals have the same meanings as under 8.

The radicals $R^{37}$ and $R^{38}$ in formula 25 and $R^{39}$ in formula 27 are derived from polyetheramines or alkanolamines of the formulae 28 a) and b), amines of the formula $NR^6R^7R^8$ and optionally from alcohols having 1 to 30 carbon atoms.

(28a)

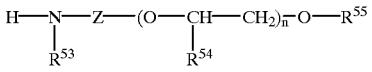

-continued (28b)

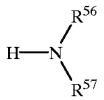

Therein is $R^{53}$ hydrogen, $C_6$–$C_{40}$-alkyl or (28c)

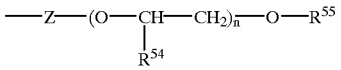

$R^{54}$ hydrogen, $C_1$- to $C_4$-alkyl $R^{55}$ hydrogen, $C_1$- to $C_4$-alkyl, $C_5$- to $C_{12}$-cycloalkyl or $C_6$- to $C_{30}$-aryl $R^{56}$, $R^{57}$ independently hydrogen, $C_1$- to $C_{22}$-alkyl, $C_2$- to $C_{22}$-alkenyl or Z—OH Z $C_2$- to $C_4$-alkylene n a number between 1 and 1000.

For derivatizing the structural units of the formulae 17 and 18, preferably mixtures of at least 50% by weight of alkylamines of the formula $HNR^6R^7R^8$ and not more than 50% by weight of polyetheramines or alkanolamines of the formulae 28 a) and b) were used.

The preparation of the polyetheramines used is possible, for example, by reductive amination of polyglycols. Furthermore, the preparation of polyetheramines having a primary amino group can be carried out by an addition reaction of polyglycols with acrylonitrile and subsequent catalytic hydrogenation. In addition, polyetheramines can be obtained by reaction of polyethers with phosgene or thionyl chloride and subsequent amination to give the polyetheramines. The polyetheramines used according to the invention are commercially available (for example) under the name ®Jeffamine (Texaco). Their molecular weight is up to 2000 g/mol and the ethylene oxide/propylene oxide ratio is from 1:10 to 6:1.

A further possibility for derivatizing the structural units of the formulae 17 and 18 comprises using an alkanolamine of the formula 28 instead of the polyetheramines and subsequently subjecting it to an oxyalkylation.

From 0.01 to 2 mol, preferably from 0.01 to 1 mol, of alkanolamine are used per mole of anhydride. The reaction temperature is from 50 to 100° C. (amide formation). In the case of primary amines, the reaction is carried out at temperatures above 100° C. (imide formation).

The oxyalkylation is usually carried out at temperatures of from 70 to 170° C. under catalysis by bases, such as NaOH or $NaOCH_3$, by treatment with gaseous alkylene oxides, such as ethylene oxide (EO) and/or propylene oxide (PO). Usually, from 1 to 500, preferably from 1 to 100, mol of alkylene oxide are added per mol of hydroxyl groups.

The following may be mentioned as examples of suitable alkanolamines: monoethanolamine, diethanolamine, N-methylethanolamine, 3-aminopropanol, isopropanol, diglycolamine, 2-amino-2-methylpropanol and mixtures thereof.

The following may be mentioned as examples of primary amines: n-hexylamine, n-octylamine, n-tetradecylamine, n-hexadecylamine, n-stearylamine and N,N-dimethylaminopropylenediamine, cyclohexylamine, dehydroabietylamine and mixtures thereof.

The following may be mentioned as examples of secondary amines: didecylamine, ditetradecylamine, distearylamine, dicocos-fatty amine, di-tallow-fatty amine and mixtures thereof.

The following may be mentioned as examples of alcohols: methanol, ethanol, propanol, isopropanol, n-, sec- and tert-butanol, octanol, tetradecanol, hexadecanol, octadecanol, tallow-fatty alcohol, behenyl alcohol and mixtures thereof. Suitable examples are mentioned in EP-A-688 796.

10. Co- and terpolymers of N-$C_6$–$C_{24}$-alkylmaleimides with $C_1$–$C_{30}$-vinyl esters, vinyl ethers and/or olefins having 1 to 30 carbon atoms, such as, for example, styrene or α-olefins. These are obtainable on the one hand by reaction of a polymer containing anhydride groups with amines of the formula $H_2NR^6$ or by imidation of the dicarboxylic acid and subsequent copolymerization. A preferred dicarboxylic acid is maleic acid or maleic anhydride. Copolymers comprising from 10 to 90% by weight of $C_6$–$C_{24}$-α-olefins and from 90 to 10% by weight of N-$C_6$–$C_{22}$-alkylmaleimide are preferred.

For optimization of the properties as flow improver and/or lubricity additive, the additives according to the invention may furthermore be used as a mixture with alkylphenol/formaldehyde resins. In a preferred embodiment of the invention, these alkylphenol/formaldehyde resins are those of the formula

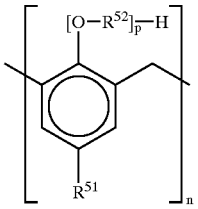

in which $R^{51}$ is $C_4$–$C_{50}$-alkyl or $C_4$–$C_{50}$-alkenyl, O—[$R^{52}$] is ethoxy and/or propoxy, n is a number from 5 to 100 and p is a number from 0 to 50.

Finally, in a further variant of the invention, the additives according to the invention are used together with comb polymers. These are understood as meaning polymers in which hydrocarbon radicals having at least 8, in particular at least 10, carbon atoms are bonded to a polymer backbone. Preferably, these are homopolymers whose alkyl side chains contain at least 8 and in particular at least 10 carbon atoms. In the case of copolymers, at least 20%, preferably at least 30%, of the monomers have side chains (cf. Comb-like Polymers-Structure and Properties; N. A. Plate and V. P. Shibaev, J. Polym. Sci. Macromolecular Revs. 1974, 8, 117 et seq.).

Examples of suitable comb polymers are fumarate/vinyl acetate copolymers (cf. EP 0 153 176 A1), copolymers of a $C_6$- to $C_{24}$-α-olefin and an N—$C_6$- to $C_{22}$-alkylmaleimide (cf. EP-A-0 320 766) and furthermore esterified olefin/maleic anhydride copolymers, polymers and copolymers of α-olefins and esterified copolymers of styrene and maleic anhydride.

For example, comb polymers can be described by the formula

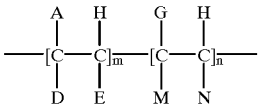

in which

A is R', COOR', OCOR', R"—COOR' or OR';

D is H, $CH_3$, A or R";

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain having 8 to 150 carbon atoms;

R" is a hydrocarbon chain having 1 to 10 carbon atoms;

m is a number from 0.4 to 1.0; and n is a number from 0 to 0.6.

The mixing ratio (in parts by weight) of the additives according to the invention with paraffin dispersants or comb polymers is in each case from 1:10 to 20:1, preferably from 1:1 to 10:1.

The additives according to the invention are suitable for improving the cold-flow and lubricating properties of animal, vegetable or mineral oils, alcoholic fuels, such as methanol and ethanol, and mixtures of alcoholic fuels and mineral oils. They are particularly suitable for use in middle distillates. Middle distillates are defined in particular as those mineral oils which are obtained by distillation of crude oil and boil within the range from 120 to 450° C., for example kerosene, jet fuel, diesel and heating oil. Preferably, the additives according to the invention are used in those middle distillates which contain not more than 500 ppm, in particular less than 200 ppm, of sulfur and in specific cases less than 50 ppm of sulfur. These are in general those middle distillates which were subjected to refinement under hydrogenating conditions and which therefore contain only small amounts of polyaromatic and polar compounds which impart natural lubricating activity to them. The additives according to the invention are furthermore preferably used in those middle distillates which have 95% distillation points of less than 370° C., in particular 350° C. and in special cases less than 330° C. The activity of the mixtures is better than that which would be expected from the individual components and from the mixtures according to the prior art. In particular, the additive combinations according to the invention perform particularly well under cold blending conditions if the temperature of the oil on incorporation of the additives is low, i.e. below 40° C., in particular below 20° C. and especially below 10° C.

The additive components according to the invention can be added to mineral oils or mineral oil distillates separately or as a mixture. When mixtures are used, solutions or dispersions which contain from 10 to 90% by weight, preferably from 20–80% by weight, of the additive combination have proven useful. Suitable solvents or dispersants are aliphatic and/or aromatic hydrocarbons or hydrocarbon mixtures, e.g. gasoline fractions, kerosene, decane, pentadecane, toluene, xylene, ethylbenzene or commercial solvent mixtures, such as Solvent Naphtha, ®Shellsol AB, ®Solvesso 150, ®Solvesso 200, ®Exxsol grades, ®ISOPAR grades and ®Shellsol D grades. Mineral oils or mineral oil distillates improved in their lubricating and/or cold flow properties by the additives contain from 0.001 to 2, preferably from 0.005 to 0.5% by weight of additive, based on the distillate.

The additives may be used alone or together with other additives, for example with other pour point depressants, dewaxing assistants, corrosion inhibitors, antioxidants, conductivity improvers, sludge inhibitors, dehazers and additives for reducing the cloud point. The addition of these additives to the oil can be effected together with the additive components according to the invention or separately.

The activity of the additives according to the invention as lubricity enhancers and cold flow improvers is explained in more detail by the following examples.

EXAMPLES

TABLE 1

Characterization of the test oil

| | Test oil 1 | Test oil 2 | Test oil 3 | Test oil 4 | Test oil 5 |
|---|---|---|---|---|---|
| Cloud point (CP) (° C.) | +1 | −9.6 | −3.2 | −4.3 | −26.8 |
| Cold filter plugging point (CFPP) (° C.) | −2 | −14 | −6 | −6 | −27 |
| Pour point (PP) (° C.) | −3 | −12 | −9 | −12 | −27 |
| n-Paraffin content (% by weight) | 23 | 21.5 | 18.9 | 18.2 | 16.8 |
| Initial boiling point (IBP) (° C.) | 163 | 172 | 187.9 | 186.9 | 185.8 |
| Boiling range 90%–20% (K.) | 104 | 76.9 | 99.8 | 102.2 | 89.9 |
| FBP-90% (K.) | 27 | 18 | 24.2 | 19.0 | 21 |
| Final boiling point (FBP) (° C.) | 332 | 336 | 359.6 | 358.6 | 320.7 |
| Density | 0.828 | 0.831 | 0.8432 | 0.8417 | 0.8193 |
| S content (ppm) | 290 | 35 | 54.2 | 478 | 6 |
| HFRR-WSD (μm) | 571 | 670 | 617 | 541 | 694 |
| Average differential time (ADT) | 5.3 | 4.2 | 6.1 | 5.9 | 4.5 |

The determination of the boiling characteristics was carried out according to ASTM D-86, the determination of the CFPP value according to EN 116 and the determination of the cloud point according to ISO 3015.

The solubility behavior of the additives is determined according to the British Rail test, as follows: 400 ppm of a dispersion of the additive combination, heated to 22° C., are metered into 200 ml of the test oil heated to 22° C. (cf. Table 3) and shaken vigorously for 30 seconds. After storage for 24 hours at +3° C., shaking is carried out again for 15 seconds and filtration is then carried out at 3° C. in three portions of 50 ml each over a 1.6 μm glass fiber microfilter (i 25 mm; Whatman GFA, Order No. 1820025). The ADT value is calculated from the three filtration times $T_1$, $T_2$, and $T_3$, as follows:

$$ADT = \frac{(T_3 - T_1)}{T_2} \cdot 50$$

An ADT value of <15 is regarded as an indication that the gas oil can be satisfactorily used in normally cold weather. Products having ADT values of >25 are considered not to be filterable.

The lubricating activity of the additives was determined by means of an HFRR apparatus from PCS Instruments. The additives heated to 22° C. are metered into the oil heated to 22° C. and are shaken vigorously for 30 seconds. After storage for 25 hours at +3° C., the oil is filtered according to the conditions of the British Rail test and the lubricating activity is determined for the filtrate in the HFRR test. The high frequency reciprocating rig test (HFRR) is described in D. Wei, H. Spikes, Wear, Vol. 111, No. 2, p. 217, 1986 and is carried out at 60° C. The results are stated as a coefficient of friction and a wear scar (WSD). A low coefficient of friction and a low wear scar indicate good lubricating activity.

Polymers:

The polymers are terpolymers of ethylene, a short-chain vinyl ester and the vinyl ester of a neocarboxylic acid ("neoester") of the following type:

Polymer A: ethylene/vinyl acetate (comparison)

Polymer B: ethylene/vinyl acetate/vinyl neodecanoate

Polymer C: ethylene/vinyl acetate/vinyl neodecanoate

Polymer D: ethylene/vinyl acetate/vinyl neododecanoate

Polymer E: ethylene/vinyl propionate/vinyl neodecanoate

TABLE 2

Properties of the flow improver polymers

| Polymer | Ethylene content mol % | Vinyl ester content mol % | Neoester content mol % | $V_{140}$ mPas |
|---|---|---|---|---|
| A | 85.2 | 14.8 | — | 125 |
| B | 90 | 4 | 6 | 105 |
| C | 84.5 | 13 | 2.5 | 230 |
| D | 86 | 10 | 4 | 195 |
| E | 85 | 13 | 2 | 170 |

For testing of the performance characteristics, the polymers were adjusted to 50% strength in kerosene.

The determination of the viscosity was carried out by means of a rotational viscometer (Haake RV 20) with a plate-cone measuring system at 140° C., in agreement with ISO 3219 (B).

Paraffin dispersants:

For use as flow improver and/or lubricity additive, the additives according to the invention can furthermore be employed as a mixture with paraffin dispersants.

The wax dispersant (F) used is a mixture of 2 parts of a terpolymer of $C_{14}/_{16}$-α-olefin, maleic anhydride and allylpolyglycol with 2 equivalents of di-tallow-fatty amine and one part of nonylphenol/formaldehyde resin.

For testing the performance characteristics, both components were adjusted to 50% strength in heavy Solvent Naphtha.

Amphiphiles

The following oil-soluble amphiphiles were used:

| | |
|---|---|
| Amphiphile 1: | Glyceryl monooleate |
| Amphiphile 2: | Polyisobutenylsuccinic anhydride, diesterified with diethylene glycol, according to Example 1 from WO-97/45507 |
| Amphiphile 3: | Oleic acid diethanolamide |
| Amphiphile 4: | $C_{18}H_{35}$—O—$CH_2$—CH(OH)—$CH_2$OH ($C_{18}$-chain is an industrial cut) |
| Amphiphile 5: | Oleic acid |
| Amphiphile 6: | Tall oil fatty acid |

Lubricating activity and cold flow improvement

For carrying out the examples according to the invention and comparative examples, said cold flow improver polymers and optionally also said wax dispersant were mixed with said amphiphiles.

TABLE 3

Activity in test oil 1

| Amphiphile, 100 ppm in each case | | Cold flow improver polymer, 200 ppm in each case A | B | C | D | E | none |
|---|---|---|---|---|---|---|---|
| 1 | WSD | 361 | 301 | 293 | 315 | 312 | 342 |
| | ADT | 24.3 | 8.1 | 7.1 | 6.7 | 9.3 | 6.1 |
| | CFPP | −9 | −8 | −10 | −11 | −10 | −1 |
| 2 | WSD | 335 | 275 | 268 | 253 | 293 | 296 |
| | ADT | 27.6 | 7.5 | 7.9 | 7.3 | 8.2 | 6.9 |
| | CFPP | −9 | −9 | −10 | −10 | −9 | −1 |
| 3 | WSD | 321 | 263 | 265 | 270 | 283 | 275 |
| | ADT | 26.5 | 7.3 | 6.9 | 7.2 | 8.6 | 6.7 |
| | CFPP | −10 | −10 | −11 | −10 | −10 | −2 |
| 4 | WSD | 383 | 325 | 310 | 312 | 325 | 330 |
| | ADT | 24.9 | 6.8 | 6.5 | 7.3 | 7.8 | 6.7 |
| | CFPP | −9 | −10 | −11 | −10 | −9 | −1 |
| 5 | WSD | 374 | 287 | 258 | 280 | 306 | 312 |
| | ADT | 32.5 | 7.8 | 7.4 | 6.8 | 8.0 | 6.8 |
| | CFPP | −9 | −9 | −10 | −10 | −9 | −2 |
| 6 | WSD | 402 | 306 | 298 | 324 | 310 | 342 |
| | ADT | 21.6 | 7.0 | 7.4 | 6.5 | 7.4 | 6.2 |
| | CFPP | −9 | −9 | −11 | −10 | −9 | −1 |
| none | WSD | 553 | 560 | 545 | 557 | 560 | 571 |
| | ADT | 25.0 | 7.8 | 6.5 | 6.6 | 8.5 | 5.3 |
| | CFPP | −9 | −9 | −10 | −9 | −9 | −2 |

TABLE 4

Activity in test oil 2

| Amphiphile, 100 ppm in each case | | Cold flow improver polymer, 200 ppm in each case A | B | C | D | E | none |
|---|---|---|---|---|---|---|---|
| 1 | WSD | 423 | 331 | 349 | 323 | 355 | 362 |
| | ADT | 31.3 | 6.2 | 5.9 | 5.5 | 6.9 | 5.1 |
| | CFPP | −18 | −19 | −21 | −21 | −18 | −14 |
| 2 | WSD | 395 | 325 | 311 | 329 | 343 | 355 |
| | ADT | 30.2 | 5.9 | 5.8 | 5.3 | 6.1 | 4.9 |
| | CFPP | −19 | −19 | −21 | −20 | −19 | −13 |
| 3 | WSD | 380 | 326 | 314 | 303 | 351 | 346 |
| | ADT | 29.7 | 5.5 | 6.1 | 5.6 | 6.3 | 4.7 |
| | CFPP | −18 | −19 | −20 | −21 | −20 | −13 |
| 4 | WSD | 410 | 341 | 355 | 339 | 340 | 345 |
| | ADT | 34.0 | 5.5 | 6.0 | 5.8 | 6.6 | 4.8 |
| | CFPP | −19 | −19 | −20 | −20 | −19 | −14 |
| 6 | WSD | 407 | 320 | 344 | 326 | 307 | 347 |
| | ADT | 30.1 | 5.4 | 5.6 | 5.2 | 4.7 | 4.1 |
| | CFPP | −19 | −21 | −18 | −20 | −21 | −14 |
| none | WSD | 643 | 650 | 632 | 649 | 620 | 670 |
| | ADT | 31.3 | 6.3 | 6.1 | 5.4 | 6.8 | 4.2 |
| | CFPP | −19 | −19 | −21 | −21 | −19 | −14 |

TABLE 5

Activity in test oil 3

| Amphiphile, 125 ppm in each case | | Cold flow improver polymer, 400 ppm in each case A | B | B + 150 ppm F | none |
|---|---|---|---|---|---|
| 1 | WSD | 405 | 373 | 339 | 351 |
| | ADT | 26.5 | 7.3 | 7.9 | 7.1 |
| | CFPP | −18 | −20 | −24 | −6 |
| 6 | WSD | 416 | 343 | 325 | 358 |
| | ADT | 21.3 | 5.5 | 5.9 | 6.3 |
| | CFPP | −19 | −21 | −24 | −6 |
| none | WSD | 621 | 603 | 562 | 617 |
| | ADT | 25.9 | 6.5 | 6.9 | 6.1 |
| | CFPP | −19 | −21 | −23 | −6 |

TABLE 6

| Amphiphile, 100 ppm in each case | | Activity in test oil 4 | | | |
|---|---|---|---|---|---|
| | | Cold flow improver polymer, 200 ppm in each case | | | |
| | | A | B | B + 150 ppm F | none |
| 1 | WSD | 456 | 378 | 341 | 385 |
| | ADT | 23.5 | 7.1 | 6.9 | 6.5 |
| | CFPP | −17 | −20 | −23 | −6 |
| 6 | WSD | 425 | 385 | 356 | 391 |
| | ADT | 19.5 | 6.9 | 6.4 | 6.1 |
| | CFPP | −19 | −19 | −22 | −6 |
| none | WSD | 538 | 534 | 509 | 541 |
| | ADT | 20.7 | 6.8 | 6.2 | 5.9 |
| | CFPP | −18 | −20 | −22 | −6 |

TABLE 7

| Amphiphile, 125 ppm in each case | | Activity in test oil 5 | | |
|---|---|---|---|---|
| | | Cold flow improver polymer, 400 ppm in each case | | |
| | | A | B | none |
| 1 | WSD | 431 | 395 | 386 |
| | ADT | 17.3 | 5.9 | 4.8 |
| | CFPP | −36 | −39 | −27 |
| 6 | WSD | 425 | 383 | 379 |
| | ADT | 16.1 | 5.1 | 4.5 |
| | CFPP | −38 | −41 | −28 |
| none | WSD | 663 | 672 | 684 |
| | ADT | 15.3 | 5.4 | 4.1 |
| | CFPP | −38 | −40 | −27 |

What is claimed is:

1. A method for the simultaneous improvement of the lubricating activity and cold flow properties for improving cold-flow and lubricating properties of a fuel oil, said method comprising adding to the fuel oil an additive under cold blending conditions wherein the temperature of the fuel oil is less than 40° C., wherein the additive comprises A) 5–95% by weight of at least one oil-soluble amphiphile of the formula 1

(1)

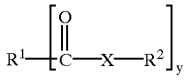

and/or 2

(2)

in which $R^1$ is an alkyl, alkenyl, hydroxyalkyl or aromatic radical having 12–35 carbon atoms, X is NH, $NR^3$, O or S, y is 1, 2, 3 or 4, $R^2$ is hydrogen or an alkyl radical carrying hydroxyl groups and having 2 to 10 carbon atoms and $R^3$ is an alkyl radical carrying nitrogen and/or hydroxyl groups and having 2 to 10 carbon atoms or $C_1$–$C_{20}$-alkyl, and B) 5 to 95% by weight of a terpolymer containing from 3 to 18 mol % of structural units derived from the vinyl ester of a carboxylic acid having 2 to 4 carbon atoms, from 0.5 to 10 mol % of structural units derived from the vinyl ester of a neocarboxylic acid having 8 to 15 carbon atoms, and structural units of ethylene to 100 mol %, and having a melt viscosity, measured at 140° C., of from 20 to 10,000 mPas.

2. The method of claim 1, wherein $R^1$ and $R^2$ together contain at least 15 carbon atoms.

3. The method of claim 1, wherein component A) is an ester of a carboxylic acid with a polyol having 2 to 8 carbon atoms.

4. The method of claim 1, wherein component A is a fatty acid having 12 to 30 carbon atoms.

5. The method of claim 1, wherein component A is a fatty acid alkanolamine or a fatty acid alkanolamide.

6. The method of claim 1, wherein the terpolymers of component B have a melt viscosity at 140° C. of from 50 to 5000 mPas.

7. The method of claim 1, wherein the terpolymers of component B) contain, as the vinyl neocarboxylate, the vinyl esters of neononanoic, neodecanoic or neoundecanoic acid.

8. The method of claim 1, wherein the additive further comprises paraffin dispersants of the formula

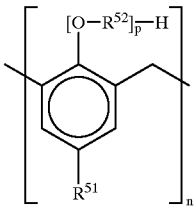

in which $R^{51}$ is $C_4$–$C_{50}$-alkyl or $C_4$–$C_{50}$-alkenyl, O—[$R^{52}$] is ethoxy and/or propoxy, n is a number from 5 to 100 and p is a number from 0 to 50, or comb polymers of the formula

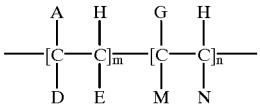

in which

A is R', COOR', OCOR', R"—COOR' or OR';

D is H, $CH_3$, A or R";

E is H or A;

G is H, R", R"—COOR', an aryl radical or a heterocyclic radical;

M is H, COOR", OCOR", OR" or COOH;

N is H, R", COOR", OCOR, COOH or an aryl radical;

R'is a hydrocarbon chain having 8 to 150 carbon atoms;

R"is a hydrocarbon chain having 1 to 10 carbon atoms;

m is a number from 0.4 to 1.0; and n is a number from 0 to 0.6, the mixing ratio of additive to paraffin dispersant or comb polymer being from 1:10 to 20:1.

9. A fuel oil composition comprising a fuel oil and the additive prepared according to the method of claim 1.

* * * * *